US006290296B1

(12) United States Patent
Beggs

(10) Patent No.: US 6,290,296 B1
(45) Date of Patent: Sep. 18, 2001

(54) ANTI-RATTLE PAD

(75) Inventor: Ken A. Beggs, Waterloo (CA)

(73) Assignee: Northfield Metal Products Limited, Waterloo (CA)

( * ) Notice: Subject to any disclaimer, the term of this patent is extended or adjusted under 35 U.S.C. 154(b) by 0 days.

(21) Appl. No.: 09/346,407

(22) Filed: Jul. 1, 1999

(51) Int. Cl.[7] ..... A47C 1/06

(52) U.S. Cl. ..... 297/344.16; 297/344.19; 297/300.1; 297/301.2; 297/302.2; 297/463.1; 248/632; 248/205.3; 248/562; 74/490; 74/470; 92/21 MR; 267/139; 267/140; 267/140.11; 267/141

(58) Field of Search ..... 297/344.16, 344.19, 297/463.1, 301.2, 302.2; 248/562, 609, 632, 205.3; 74/490, 470; 267/139, 140, 140.11, 141, 145, 153, 292

(56) References Cited

U.S. PATENT DOCUMENTS

| | | | | |
|---|---|---|---|---|
| 1,937,055 | * | 11/1933 | Curtiss | 248/632 |
| 2,779,390 | * | 1/1957 | Freeman | 248/632 X |
| 2,787,315 | * | 4/1957 | Siebert | 248/632 X |
| 3,604,675 | * | 9/1971 | Mitchell et al. | 248/632 |
| 3,711,054 | * | 1/1973 | Bauer | 297/344.19 X |
| 3,756,654 | * | 9/1973 | Bauer | 297/344.19 |
| 3,770,235 | * | 11/1973 | Klapproth et al. | 248/632 X |
| 3,880,465 | * | 4/1975 | Scheben | 297/344.19 |
| 4,220,307 | * | 9/1980 | Hale | 297/344.19 X |
| 4,257,582 | * | 3/1981 | Wirges | 297/344.19 X |
| 4,338,151 | * | 7/1982 | Hutter, III | 248/205.3 X |
| 4,640,548 | * | 2/1987 | Desanta | 297/300.1 X |
| 4,662,591 | * | 5/1987 | Encontre | 248/205.3 X |
| 4,668,546 | * | 5/1987 | Hutter, III | 248/205.3 X |
| 4,756,496 | * | 7/1988 | Hosan et al. | 297/344.19 X |
| 4,822,224 | * | 4/1989 | Carl et al. | 248/205.3 X |
| 4,879,857 | * | 11/1989 | Peterson et al. | 248/632 X |
| 4,958,849 | * | 9/1990 | Pinch et al. | 248/632 X |
| 4,991,412 | * | 2/1991 | Bauer et al. | 248/562 X |
| 5,280,998 | * | 1/1994 | Miotto et al. | 297/344.19 X |
| 5,284,312 | * | 2/1994 | Dony | 297/344.19 X |
| 5,295,755 | * | 3/1994 | DeHann, III et al. | 248/205.3 X |
| 5,366,200 | * | 11/1994 | Scura | 248/632 |
| 5,427,434 | * | 6/1995 | Hybarger | 297/344.19 X |
| 5,630,649 | * | 5/1997 | Heidmann et al. | 297/344.19 |
| 5,641,140 | * | 6/1997 | Sorenson | 248/205.3 |
| 5,975,889 | * | 11/1999 | Culpepper | 248/205.3 X |
| 5,992,940 | * | 11/1999 | Chen | 297/463.1 |
| 6,022,077 | * | 2/2000 | Kirkland et al. | 297/344.19 |
| 6,030,037 | * | 2/2000 | Ritch et al. | 297/344.19 X |
| 6,039,496 | * | 3/2000 | Bishop | 248/205.3 X |
| 6,045,187 | * | 4/2000 | Stumpf | 297/344.19 |

* cited by examiner

*Primary Examiner*—Peter M. Cuomo
*Assistant Examiner*—Rodney B. White
(74) *Attorney, Agent, or Firm*—Wood, Herron & Evans

(57) ABSTRACT

A chair height control mechanism has a gas cylinder with a valve control finger extending from an upper end overlain by a tilting actuator. A resilient pad is adhered to the upper end of the gas cylinder surrounding the valve control finger and maintains a spacing between the valve control finger and actuator when the actuator is not in use to avoid rattle.

8 Claims, 2 Drawing Sheets

ANTI-RATTLE PAD

FIELD OF THE INVENTION

This invention relates to an anti-rattle pad and to a chair control mechanism incorporating such a pad.

BACKGROUND OF THE INVENTION

To minimize manufacturing cost, it is desirable to minimize the complexity of chair control mechanisms. On the other hand, it is also desirable to provide chair control mechanisms which give a user an impression of quality. These two desirata may conflict which may result in a manufacturing compromise. Since chair control mechanisms are generally made of metal or hard plastic, one problem encountered by simplified mechanisms is rattle.

This invention seeks to provide a simple chair control mechanism incorporating a gas cylinder which avoids raffle of the gas cylinder lever.

SUMMARY OF THE INVENTION

A chair control mechanism has a gas cylinder with a valve control finger extending from one end overlain by an actuator. An annular resilient pad is mounted to this end of the gas cylinder surrounding the valve control finger and maintains a spacing between the valve control finger and actuator when the actuator is not in use to avoid rattle. To allow retrofitting of a pad to the chair control mechanism, the pad may comprise an adhesive layer covered by an annular release tape.

Therefore, according to the present invention, there is provided a pad, comprising: an annular disk fabricated of a resilient material having an adhesive layer on a face, which face extends from an annulus of said disk; and an annular release tape releasably adhered to said adhesive layer.

In another aspect, there is provided a chair control mechanism, comprising: a gas cylinder with a valve control finger extending from one end; a gas cylinder actuator disposed over said valve control finger; and an annular disk fabricated of a resilient material mounted on said one end of said cylinder surrounding said valve control finger and perpetually deformed into a compressed state by said gas cylinder actuator so that said disk perpetually urges said actuator away from said valve control finger.

BRIEF DESCRIPTION OF THE DRAWINGS

In the figures which illustrate example embodiments of the invention.

DETAILED DESCRIPTION OF THE PREFERRED EMBODIMENTS

Figure 1:
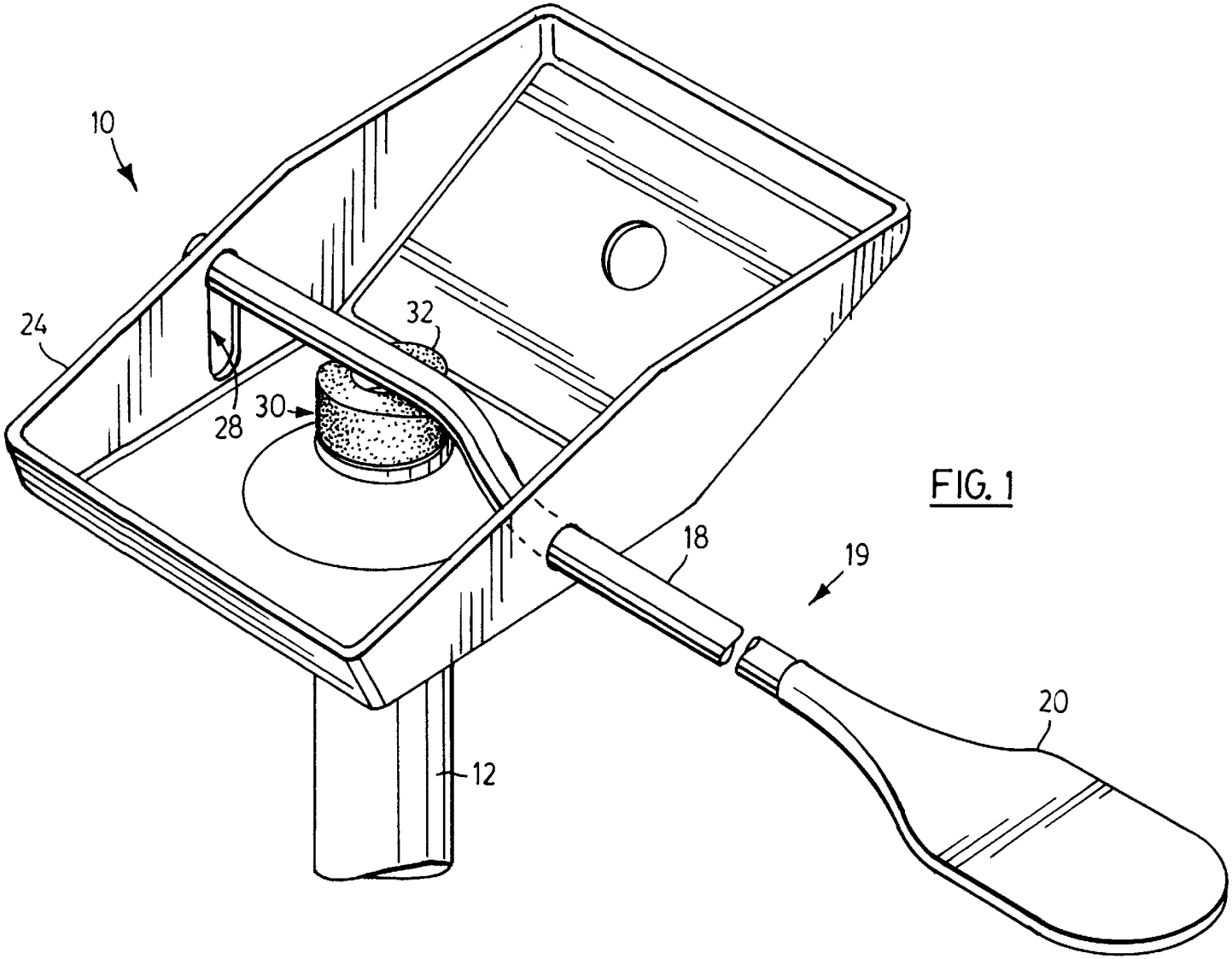
FIG. 1 a perspective view of a chair control mechanism mad in accordance with this invention.
Figure 2:
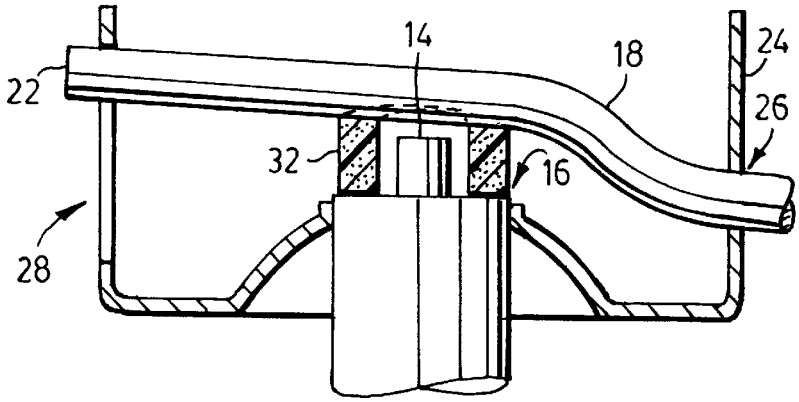
FIG. 2 is a cross-sectional view of FIG. 1.

Referencing FIGS. 1 and 2, a chair height control mechanism 10 comprises a gas cylinder 12 with a gas cylinder valve control finger 14 extending from upper end 16 of the cylinder. A gas cylinder actuator 19 comprises a rod 18 terminating at one end in a paddle 20. A chair seat bracket 24 is supported by the gas cylinder 12. Rod 18 passes through openings 26, 28 in opposite sides of the chair seat bracket 24 and terminates in rod end 22. These openings are located such that rod 18 is disposed above the valve control finger 14 and opening 28 is elongated so that a user may grasp paddle 20 and tilt rod 18 toward the valve control finger 14 in order to depress this finger. The chair control mechanism includes a pad 30 comprising an annular disk 32 fabricated of a resilient material such as foam. Disk 32 is mounted on upper end 16 of cylinder 12 surrounding the valve control finger 14. Disk 32 is perpetually deformed into a compressed state by reason of elongated opening 28 limiting the movement of rod 18 away from valve control finger 14. In consequence, the disk 32 perpetually urges the actuator 19 away from said valve control finger 14.

Figure 3:
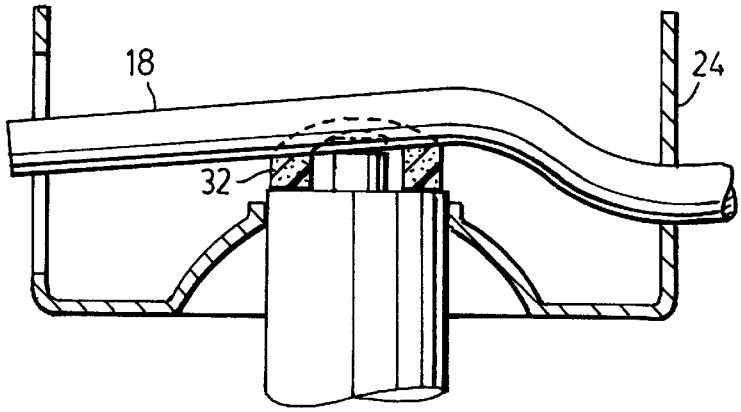
FIG. 3 is a cross-sectional view similar to FIG. 2 except showing the chair control mechanism in an operative state.

In operation, when the actuator is in its inoperative position shown in FIGS. 1 and 2, pad 30 prevents rod 18 of actuator 19 from contacting the valve control finger 14 and, therefore, prevents rattle between these two parts. A user may grasp paddle 20 and overcome the urging of disk 32 to tilt rod 18 in order to depress the valve control finger 14 to a position shown in FIG. 3. In a known manner, the length of the gas cylinder may then be adjusted to change the height of the chair seat bracket 24.

Valve control finger 14 is biased to its extended, valve closing, position. Therefore, when the user releases the paddle, the control finger returns to its extended position, pushing rod 18 upwardly. The disk 32 also urges rod 18 upwardly even after the valve control finger has reached its extended position so as to tilt the rod until its free end 22 contacts the top of elongated opening 28, whereat the rod 18 is spaced from the valve control finger 14.

Figure 4:
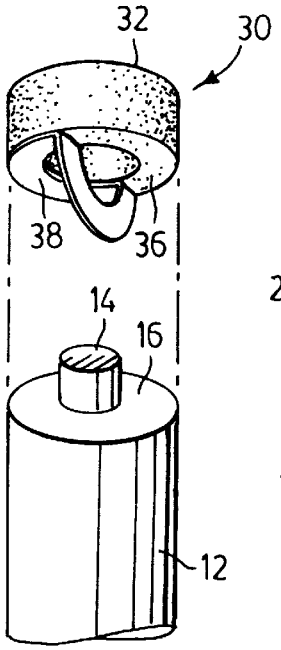
FIG. 4 is an exploded assembly view.
Figure 5:
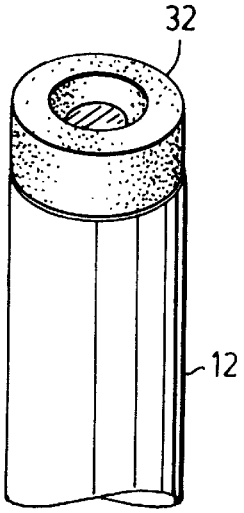
FIG. 5 is a perspective view of a portion FIG. 1.

As shown in FIG. 4, pad 30 comprises a layer 36 of adhesive on one face by way of which the pad may be mounted to the upper end 16 of cylinder 12. To facilitate retrofitting of a chair control mechanism 10 (FIG. 1) with pad 30, the pad may also include an annular release tape 38 covering the adhesive layer 36. Referencing all of the figures, to retrofit a chair control mechanism, the chair seat bracket 24 is removed from the cylinder 12, the release tape 38 is removed from adhesive pad 30 and the pad is adhered to the upper end 16 of gas cylinder 12, as shown in FIG. 5. Now the chair bracket may be refitted to the gas cylinder and, in so doing, disk 32 of pad 30 will be deformed into its compressed state by rod 18 of actuator 19. The retrofitted chair control mechanism is then ready for use. In a similar manner, a pad 30 may be replaced if this proved necessary.

While chair control mechanism 10 is shown to control the height of a chair seat bracket, chair control mechanisms controlling other aspects of a chair (such as the tilt of a backrest) could be made using the same principles.

Other modifications will be apparent to those skilled in the art and, therefore, the invention is defined in the claims.

What is claimed is:

1. A chair control mechanism, comprising:

a gas cylinder with a valve control finger extending from one end;

a gas cylinder actuator disposed over said valve control finger;

an annular disk fabricated of a resilient material mounted on said one end of said cylinder surrounding said valve control finger and perpetually deformed into a compressed state by said gas cylinder actuator so that said disk perpetually urges said actuator away from said valve control finger.

2. The chair control mechanism of claim 1 wherein said disk is adhered to said one end of said cylinder by an adhesive layer on said disk.

3. The chair control mechanism of claim 2 wherein said gas cylinder actuator comprises a rod extending generally transversely of said gas cylinder and overlying said valve control finger.

4. The chair control mechanism of claim 3 including a seat bracket mounted on said gas cylinder, said seat bracket having openings for receiving said rod, one of said openings being elongated so as to permit said rod to tilt toward said valve control finger, said elongated opening also limiting movement of said rod away from said valve control finger such that said disk is perpetually deformed by said actuator.

5. The chair control mechanism of claim 4 wherein said disk is fabricated of foam.

6. The chair control mechanism of claim 1 wherein said gas cylinder actuator comprises a rod extending generally transversely of said gas cylinder and overlying said valve control finger.

7. The chair control mechanism of claim 6 including a seat bracket mounted on said gas cylinder, said seat bracket having openings for receiving said rod, one of said openings being elongated so as to permit said rod to tilt toward said valve control finger, said elongated opening also limiting movement of said rod away from said valve control finger such that said disk is perpetually deformed by said actuator.

8. The chair control mechanism of claim 1 wherein said disk is fabricated of foam.

* * * * *